US007081879B2

(12) United States Patent
Sun et al.

(10) Patent No.: US 7,081,879 B2
(45) Date of Patent: Jul. 25, 2006

(54) DATA DRIVER AND METHOD USED IN A DISPLAY DEVICE FOR SAVING SPACE

(75) Inventors: Wein-Town Sun, Kao-Hsiung (TW); Shin-Hung Yeh, Taipei (TW)

(73) Assignee: AU Optronics Corp., Hsin-Chu (TW)

( * ) Notice: Subject to any disclaimer, the term of this patent is extended or adjusted under 35 U.S.C. 154(b) by 349 days.

(21) Appl. No.: 10/249,751

(22) Filed: May 5, 2003

(65) Prior Publication Data

US 2004/0174347 A1 Sep. 9, 2004

(30) Foreign Application Priority Data

Mar. 7, 2003 (TW) ..... 92105024 A

(51) Int. Cl.
*G09G 3/36* (2006.01)

(52) U.S. Cl. ..... 345/99; 345/87; 345/88; 345/98; 345/103

(58) Field of Classification Search ..... 345/99, 345/84–100, 209, 206, 690, 205, 204, 545, 345/8, 103, 83, 649; 396/429; 712/16; 348/719
See application file for complete search history.

(56) References Cited

U.S. PATENT DOCUMENTS 5,341,470 A * 8/1994 Simpson et al. ..... 345/545
5,581,778 A * 12/1996 Chin et al. ..... 712/16
5,673,059 A * 9/1997 Zavracky et al. ..... 345/8
6,049,321 A * 4/2000 Sasaki ..... 345/99
6,940,496 B1 * 9/2005 Kim ..... 345/204
6,943,766 B1 * 9/2005 Nakamura et al. ..... 345/98
6,980,191 B1 * 12/2005 Nakamura et al. ..... 345/98
7,030,852 B1 * 4/2006 Ito et al. ..... 345/103
2001/0015711 A1 * 8/2001 Aoki ..... 345/92
2001/0035862 A1 * 11/2001 Nakamura et al. ..... 345/204
2002/0036625 A1 * 3/2002 Nakamura ..... 345/204
2002/0110376 A1 * 8/2002 MacLean et al. ..... 396/429
2003/0067434 A1 * 4/2003 Haga et al. ..... 345/98
2003/0202000 A1 * 10/2003 Kudo et al. ..... 345/690
2005/0057580 A1 * 3/2005 Yamano et al. ..... 345/690
2005/0231456 A1 * 10/2005 Nakamura et al. ..... 345/98

* cited by examiner

*Primary Examiner*—Bipin Shalwala
*Assistant Examiner*—Prabodh Dharia
(74) *Attorney, Agent, or Firm*—Winston Hsu

(57) ABSTRACT

A data driver includes an input module, a plurality of latches, a plurality of shift registers, and a digital-to-analog converter (DAC). The method includes utilizing the input module to receive an N-bit digital data set that is classified into m groups, wherein m and n are integers with values either equal to or greater than two. The method further includes utilizing the shift registers to output a plurality of switch signals so as to store the m groups of digital data into the latches in sequence, transmitting the m groups of digital data into the DAC in sequence according to the switch signals, transforming the m groups of digital data into a corresponding analog voltage signal in sequence, and outputting the analog voltage signal to a data line in sequence for pre-charging and driving the data line.

18 Claims, 4 Drawing Sheets

Fig. 1 Prior Atr

DATA DRIVER AND METHOD USED IN A DISPLAY DEVICE FOR SAVING SPACE

BACKGROUND OF INVENTION

1. Field of the Invention

The invention relates to a data driver and related method for driving data, and more particularly, to a digital data driver and related method for driving at least a data line of a display device to save space and to pre-charge the data line.

2. Description of the Prior Art

Liquid display devices (LCD), which are thin, flat panel display devices, can be found in a plethora of electronic goods, ranging from notebook computers and digital cameras to flight avionics and medical diagnostic tools. LCDs offer crisp, high-resolution images, and have the primary advantage of offering relatively low power-consumption rates while still maintaining good color contrast and screen refresh rates. In recent years, the newly developed low-temperature Poly Silicon LCD (LTPS LCD) can directly attach the driving circuit on the glass substrate so that the quantity of the driving circuits can be reduced, the package/material cost can be downsized, and the reliability and compactness of the commercialized products can be significantly increased.

The LCD system can be separated into "digital type" and "analog type" according to different types of input data. For achieving advantages of power saving, integrity, and cost effectiveness, more LCD systems adopt the digital type of input data so that the digital-to-analog converter should be involved in the data driver. For matching the digital-to-analog transformation, some latch circuits or sample/hold circuits should be integrated into the data driver and installed before the corresponding digital-to-analog converter. Please refer to FIG. 1, which is a functional block diagram of a prior-art data driver 10. The data driver 10 corresponds to the three ingredient colors R, G, B of a pixel 11 of a display device. The data driver 10 includes an input module 12, two grades of latches 14, 16 (first-grade latches 14 and second-grade latches 16), a shift register 11, and three digital-to-analog converters 20*r*, 20*b*, 20*g*. The input module 12 includes three N-bit circuit lines 12*r*, 12*b*, 12*g*, and each N-bit circuit line can be used to receive an N-bit digital data set. Each N-bit digital data set corresponds to one of the three ingredient colors R, G, B of the pixel 11 of the display device (the N-bit digital data set DR0–DR5 corresponds to the ingredient color R of the pixel 11; the N-bit digital data set DB0–D5B corresponds to the ingredient color B of the pixel 11; the N-bit digital data set DG0–DG5 corresponds to the ingredient color G of the pixel 11). N is an integer whose value is greater than or equal to 2. As shown in FIG. 1, N is defined as 6, that is, each digital data set is the 6-bit digital data set. Two grades of latches 14, 16 are electrically connected to the input module 12 for level shifting and buffering. Each grade of latches includes three latches that respectively correspond to the three ingredient colors R, G, B of the pixel 11 (the first-grade latches 14 include three latches 14*r*, 14*b*, 14*g*, and the second-grade latches 16 include three latches 16*r*, 16*b*, 16*g*). Each latch can be used to temporarily store the N-bit digital data set so that each latch is designed as an N-bit latch. The shift register 18 can output a switch signals SR to transmit the N-bit digital data set, which corresponds to the three ingredient colors R, G, B of the pixel 11, at one time to the first-grade latches. The first-grade latches 14 will execute the level-shifting and buffering functions. Afterwards, the N-bit digital data set will be transmitted to the second-grade latches 16 that still execute level-shifting and buffering functions. The digital-to-analog converters 20*r*, 20*b*, 20*g* are electrically connected to the second-grade latches 16 for receiving the N-bit digital data set outputted from the second-grade latches 16 and for transforming the N-bit digital data set into an analog voltage signal. The analog voltage signal the will be applied to the data lines 22*r*, 22*b*, 22*g*. The color displaying performance of the display device depends on the amplitude of the analog voltage signal. Usually, a switch LP is installed between the first-grade latches 14 and the second-grade latches 16 of the data driver 10 to control the time by which the N-bit digital data set temporarily stored in the first-grade latches 14 can be one-time transmitted to the second-grade latches 16 so that the charging time in the digital-to-analog converters 20*r*, 20*b*, 20*g* can be well controlled and sufficient. The above-mentioned prior art related to the digital data driver has been disclosed in some prior patents and documents. Yojiro Matsueda et al. presented that the data driver can be fabricated on the glass substrate by LTPS technique and a novel digital 6-bit data driver is achieved in 96 Digest, "Low Temperature poly-Si TFT-LCD with integrated 6-bit Digital data driver". In addition, for improving the data transformation process, they integrated the related latch circuits into the data driver and installed the latch circuits in front of the digital-to-analog converters.

From the above-mentioned prior art, for temporarily storing the N-bit digital data set in the digital data driver, each latch should be designed as an N-bit latch. Nowadays, because the users require finer display quality, the display device should be designed with more delicacy. For instance, if a display panel is equipped with a 4096-color performance, the digital data set should be the 4-bit digital data set. Then the data driver should comprise 4 bit digital-to-analog converters and 4-bit latch circuits. Similarly, if a display panel is equipped with a 262144-color performance, the digital data set should be the 6-bit digital data set. In the meanwhile, the data driver should comprise 6-bit digital-to-analog converters and 6-bit latch circuits. However, with better dpi-performance (dots per inch) of the display panel, the space for each pixel should be reduced so that the space for accommodating the data driver is constrained. Therefore, two different solutions are raised in order to solve the problem. Instead of fabricating the data driver on the glass substrate by LTPS technique, the first solution adopts adhering the data driver on the glass substrate as a typical a-Si LCD process. The first solution still leaves lots of doubts in tolerating temperature fluctuations and lacks many advantages of LTPS technique in small/middle-size-panel applications. Morita et al. in Toshiba Corp. suggested a selecting circuit so that the circuit designer can share the functions of the digital-to-analog converters and latch circuits so as to reduce the space occupation of the data driver in an academic document, "A 2.15 inch QCIF reflective color TFT-LCD with integrated 4-bit DAC driver", IDW '00, pp. 1149–1150. Therefore, the quantity of the digital-to-analog converters and latch circuits can be greatly reduced. However, each latch circuit still has to process the same bit number as that of each digital data set. That is, if the digital data set is a 4-bit digital data set, the corresponding latch circuit should be a 4-bit latch circuit. Similarly, if the digital data set is a 6-bit digital data set, the corresponding latch circuit should be a 6-bit latch circuit. Therefore, the design of the prior art still leaves a lot of room for improvement in saving circuit space.

SUMMARY OF INVENTION

It is therefore a primary objective of the claimed invention to provide a digital data driver combined with a grouping method to drive at least a data line of a display device for saving space and for pre-charging the data line to solve the above-mentioned problems.

According to the claimed invention, a method for driving data in a data driver is disclosed. The data driver is used for driving at least a data line of a display device. The data driver comprises an input module comprising an N-bit circuit line for receiving an N-bit digital data set, the N-bit digital data set comprising m groups of digit data, wherein N and m are both integers greater than or equal to 2; a plurality of latches electrically connected to the input module, each latch temporarily storing a group of digit data of the digital data set; a plurality of shift registers for sequentially outputting a plurality of switch signals to determine a sequence by which the m groups of digit data are transmitted to the plurality of latches; and a digital-to-analog converter electrically connected to the plurality of latches for receiving the digital data set outputted from the plurality of latches to transform the digital data set into an analog voltage signal and to output the analog voltage signal to the data line. The method comprises utilizing the N-bit circuit line of the input module to receive the digital data set; utilizing the plurality of shift registers to sequentially output a plurality of switch signals to sequentially transmit the m groups of digit data to the plurality of latches for temporary storing; sequentially transmitting the temporarily stored m groups of digit data to the digital-to-analog converter according to the sequence for the digital-to-analog converter to receive the digital data set; and utilizing the digital-to-analog converter to transform the digital data set into the analog voltage signal and to output the analog voltage signal to the data line; wherein according to the sequence by which the shift register outputs the switch signals, a group of digit data of the m groups of digit data the corresponding first arriving to the digital-to-analog converter will pre-charge the data line.

According to the claimed invention, a data driver for driving at least a data line of a display device is disclosed. The data driver comprises N bit-lines corresponding an N-bit digital data set for receiving the digital data set and for classifying the N-bit digital data set into m groups of digit data, wherein N and m are both integers greater than or equal to 2; m shift registers for sequentially outputting m switch signals to determine a sequence by which the m groups of digit data are transmitted; a plurality of latches electrically connected to the N bit-lines for temporarily storing the digital data set from the N bit-lines; and at least a digital-to-analog converter for receiving digital signals outputted from the plurality of latches to transform the digital signals into an analog voltage signal and to output the analog voltage signal to the data line; wherein after the N bit-lines receive the N-bit digital data set and classify the N-bit digital data set into m groups of digit data, the m groups of digit data will be sequentially transmitted to the corresponding latch for temporary storing according to the sequence by which the m shift registers generate the switch signals, and the temporarily stored m groups of digit data will be sequentially transmitted to the corresponding digital-to-analog converter according to the sequence, and afterwards the digital-to-analog converter will transform the digital signal into the analog voltage signal and output the analog voltage signal to the data line.

It is an advantage of the claimed invention that the method of the claimed invention is executed by classifying an N-bit digital data set into m groups of digit data. Afterwards, m shift registers generate m adjacent pulse signals, and the m groups of digit data will be sequentially inputted into a set of latches for temporary storing according to the sequence of rising time of the m adjacent pulse signals. Therefore, each latch only requires including N/m latch circuits instead of including N latch circuits to deal with the N-bit digital data set. The space of a related digital data driver according to the claimed invention can be reduced.

It is an advantage of the claimed invention that a group of digit data among the m groups of digit data first arriving to a corresponding digital-to-analog converter will pre-charge a corresponding data line to increase the stability and the life time of the related digital data driver.

These and other objectives of the claimed invention will no doubt become obvious to those of ordinary skill in the art after reading the following detailed description of the preferred embodiment, which is illustrated in the various figures and drawings.

DETAILED DESCRIPTION

Figure 1:
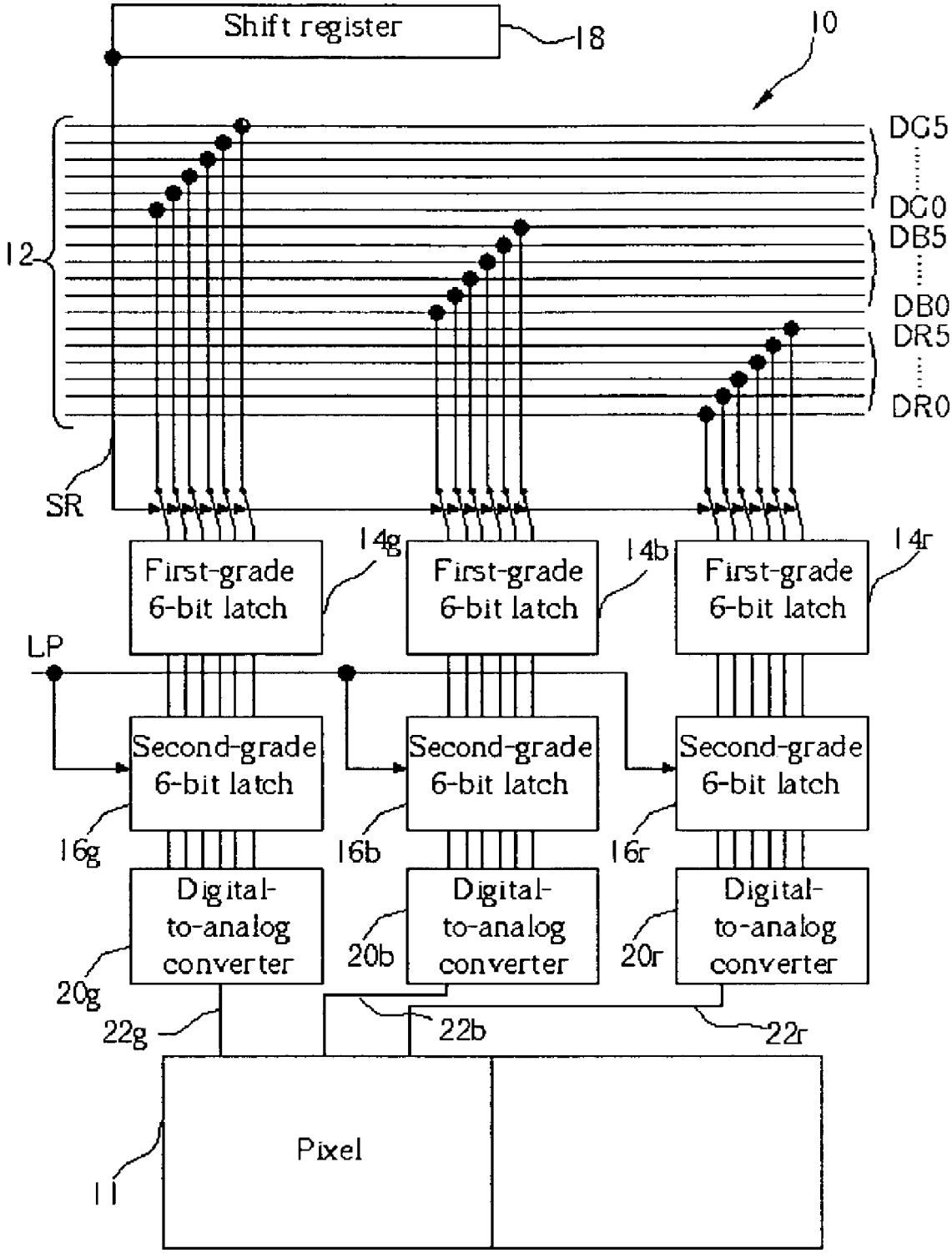
FIG. 1 is a functional block diagram of a prior-art data driver.
Figure 2:
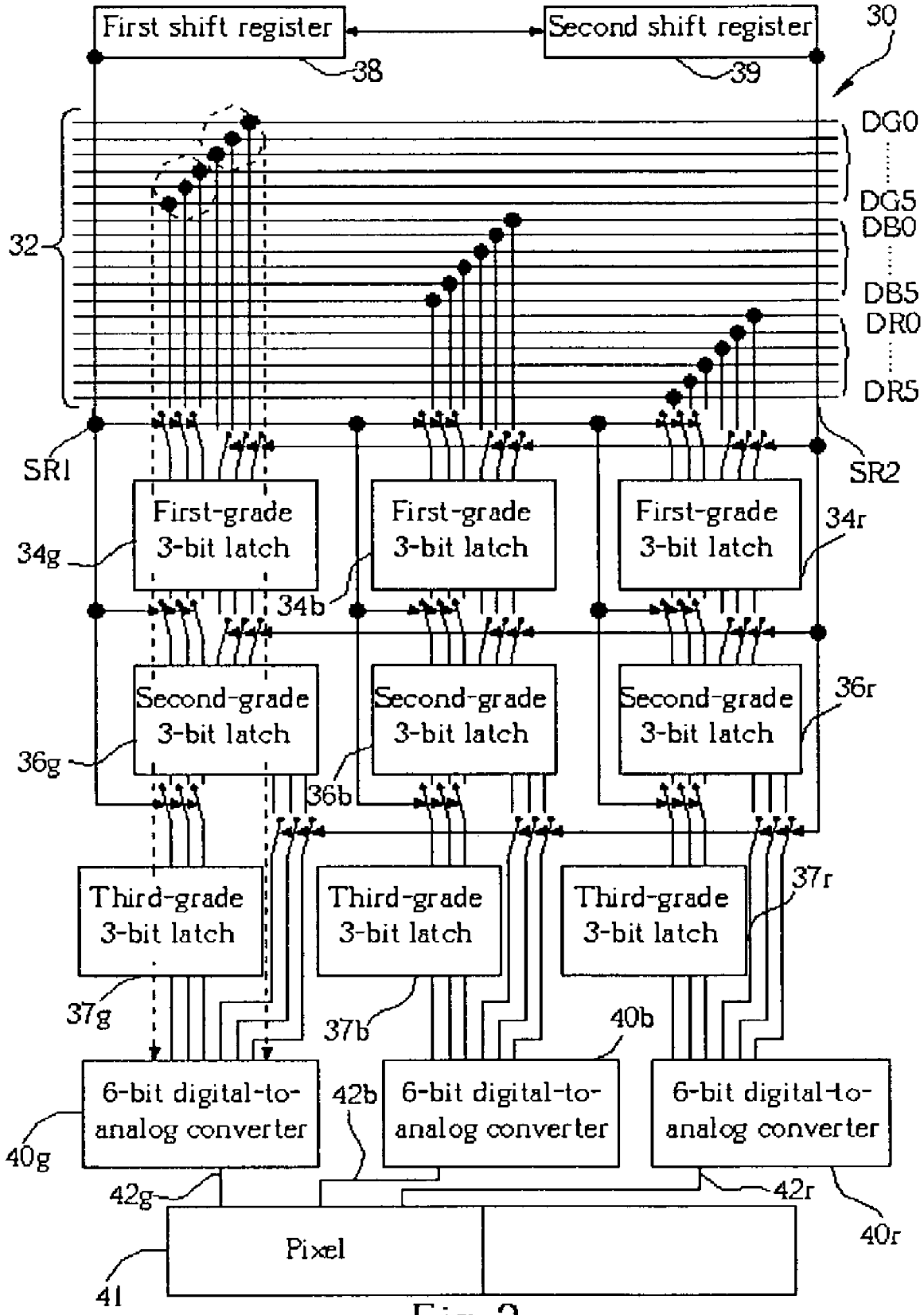
FIG. 2 is a functional block diagram of an embodiment of a data driver according to the present invention.
Figure 3:
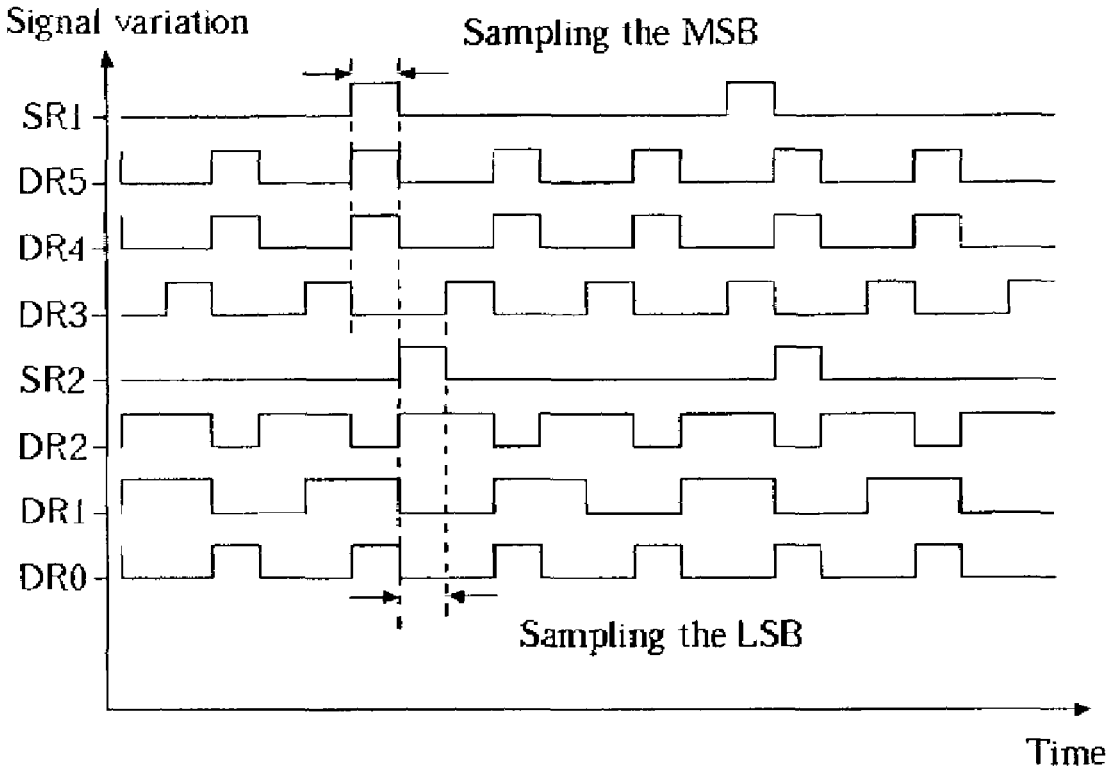
FIG. 3 is a schematic diagram showing the variations of a plurality of signals as shown in FIG. 2 based on a time dimension.

The main characteristic of the present invention is to classify an N-bit digital data set into m groups of digit data, and to utilize at least m shift registers to control the sequence by which the m groups of digit data are transmitted to the corresponding latches. Please refer to FIG. 2, which is a functional block diagram of an embodiment of a data driver 30 according to the present invention. The data driver 30 corresponds to the three ingredient colors R, G, B of a pixel of a display device. The data driver 30 includes an input module 32, three grades of latches 34, 36, 37 (a first-grade latch 34, a second-grade latch 36, and a third-grade latch 37), two shift registers 38, 39 (a first shift register 38 and a second shift register 39), and three digital-to-analog converters (DAC) 40*r*, 40*b*, 40*g*. The input module 32 includes three N-bit circuit lines, and each N-bit circuit line can receive an N-bit digital data set. Each N-bit digital data set corresponds to one of the three ingredient colors R, G, B of the pixel of the display device (the N-bit digital data set DR0–DR5 corresponds to the ingredient color Rofthe pixel; the N-bit digital data set DB0–D5B corresponds to the ingredient color B of the pixel; the N-bit digital data set DG0–DG5 corresponds to the ingredient color G of the pixel). N is greater than or equal to 2. As shown in FIG. 2, N is equal to 6. That is, in the present embodiment, each digital data set is a 6-bit digital data set. The three grades of latches are electrically connected to the input module 32 for executing functions of level shifting and buffering. Each grade of latches includes three latches, which respectively correspond to the three ingredient colors R, G, B of the pixel of the display device (the first-grade latch 34 includes three latches 34*r*, 34*b*, 34*g*; the second-grade latch 36 includes three latches 36*r*, 36*b*, 36*g*, and the third-grade latch 37 includes three latches 37*r*, 37*b*, 37*g*). Two shift registers 38, 39 are designed to sequentially output two switch signals SR1, SR2 (a first switch signal SR1 and a second switch signal SR2). Please refer to FIG. 3, which is a schematic diagram showing the variations of the two switch signals SR1, SR2 and the 6-bit digital data set on a time dimension. As shown in FIG. 2 and FIG. 3, taking the digital data set DR0–DR5 as an example, the first switch signal SR1 and the second switch signal SR2 are two adjacent pulse signals. The rising time of the first switch signal SR1 is just earlier than that of the second switch signal SR2. The digital-to-analog converters 40*r*, 40*b*, 40*g* are electrically connected to the second-grade latch 36 and the third-grade latch 37 for receiving the digital data set outputted from the second-grade latch 36 and the third-grade latch 37. Moreover, the digital-to-analog converters 40*r*, 40*b*, 40*g* can transform the digital data set into an analog voltage signal and respectively output the analog voltage signal to the data lines 42*r*, 42*b*, 42*g*, to control the color quality of the display panel.

The above-mentioned embodiment discloses the data driver 30 according to the present invention based on a "grouping method" of the present invention. As shown in FIG. 2, each 6-bit digital data set is classified into two groups of digit data. One group of digit data is defined as an MSB: DR5–DR3, DB5–DB3, DG5–DG3, and the other group ofdigit data is defined as an LSB: DR2–DR0, DB2–DB0, DG2–DG0. Therefore, each group of digit data includes three bits of each 6-bit digital data set. The two shift registers 38, 39 can be used to control the sequence by which the two groups of digit data are transmitted to the latches. Please notice that, in the embodiment as shown in FIG. 2, due to that each 6-bit digital data set is classified into two groups of digit data, m is equal to 2. Therefore, each latch only needs to temporarily store 3-bit (N/m=3) digital data set. That is, each latch can be designed as a 3-bit latch. In other words, each latch includes three (N/m=3) latch circuits to deal with 3-bit digital data set. Please continue to refer to FIG. 2 and FIG. 3. After the two groups of digit data, the MSB and the LSB, are received from the N-bit (6-bit) circuit line of the input module 32, when the first switch signal SR1 generated by the first shift register 38 rises, the MSB (DR5–DR3 as shown in FIG. 3) will be sampled into the first-grade 3-bit latches 34*r*, 34*b*, 34*g*, the second-grade 3-bit latches 36*r*, 3*b*, 36*g*, and the third-grade 3-bit latches 37*r*, 37*b*, 37*g* and be temporarily stored in the three grades of latches. Afterwards, the MSB will be transmitted to the digital-to-analog converters 40*r*, 40*b*, 40*g* for determining the transformed voltage of the MSB. After that, when the second switch signal SR2 generated by the second shift register 39 rises, the LSB (DR2–DR0 in FIG. 3) will be sampled into the first-grade 3-bit latches 34*r*, 34*b*, 34*g* and the second-grade 3-bit latches 36*r*, 3*b*, 36*g*. The initially stored MSB in the two grades of latches will be replaced by the LSB. Therefore, the MSB will arrive to the digital-to-analog converters 40*r*, 40*b*, 40*g*, earlier than the LSB by a switch signal rising time. Please notice that the third-grade 3-bit latches are still temporarily stored with the MSB. Immediately after the MSB is transmitted to the digital-to-analog converters 40*r*, 40*b*, 40*g* for determining the voltage of the MSB, the LSB is transmitted to the digital-to-analog converters 40*r*, 40*b*, 40*g* to determine the voltage of the LSB. The voltage of the LSB and the voltage of the MSB will be merged to become the final transformed analog voltage signal, which will be applied to the data lines 42*r*, 42*b*, 42*g* and to the pixel 41.

From the above-mentioned embodiments, some characteristics of the present invention can be reached. First, instead of transmitting the digital data set to the latches one at a time in the prior art, the present invention classifies an N-bit digital data set into m groups of digit data and transmits the m groups of digit data sequentially to the latches. Therefore, the m shift registers are installed to generate the m switch signals for controlling the sequence of the transmission of the m groups of digit data. In the embodiment as shown in FIG. 2, m is set as 2, and the digital data set is a 6 bit digital data set (N=6). When being practically implemented, the values of N and m should not be limited. Similarly, the quantity of the shift registers should not be constrained as m. That is, as long as the shift registers can separately transmit the m groups of digit data to the corresponding latches, the quantity of the shift registers is not required to match the quantity of groups of digit data. Moreover, the switch signals generated by the shift registers are not required to be adjacent pulse signals.

Second, the present embodiment includes three grades of latches for taking the system stability into consideration. Due to that the method of present invention is to classify the N-bit digital data set into m groups of digit data, at least m grades of latches are required to respectively temporarily store the m groups of digit data. Therefore, in the embodiment as shown in FIG. 2, two grades of latches is the minimum requirement for latching and level-shifting these two groups of digit data. In summary, the quantity of grades of latches should not be limited on condition that the quantity of grades of latches should be equal to or greater than the quantity of groups of digit data. Regarding the quantity of latch circuits in each latch according to the present invention, each latch of the grade of latches can comprise N/m latch circuits or comprise a plurality of latch circuits whose quantity is slightly greater than the integer N/m. As the quantity of N/m latch circuits in each latch becomes higher, the space-saving advantage of the present invention becomes more effective.

Figure 4:
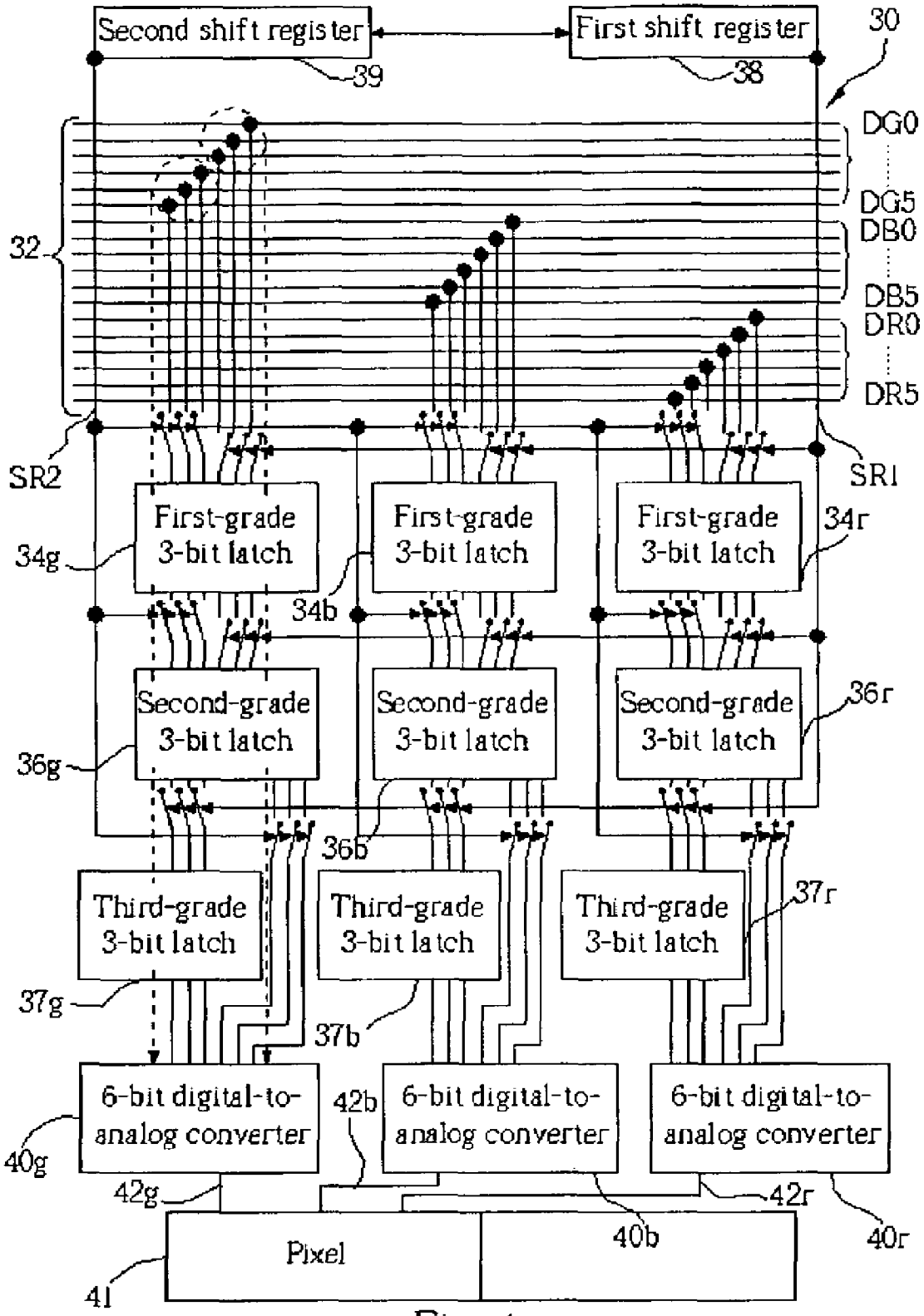
FIG. 4 is a functional block diagram of another embodiment of a data driver according to the present invention.

At last, another crucial characteristic of the present invention lies in the pre-charge effect by the group of digit data among the n groups of digit data first arriving to the corresponding digital-to-analog converter according to the sequence by which the shift register outputs the switch signals. In the embodiment as shown in FIG. 2, the MSB will first be transmitted to the digital-to-analog converters 40*r*, 40*b*, 40*g* for determining the transformed voltage of the MSB to pre-charge the data lines 42*r*, 42*b*, 42*g*. Afterwards, the LSB is transmitted to the digital-to-analog converters 40*r*, 40*b*, 40*g* to determine the voltage of the LSB. The voltage of the LSB and the voltage of the MSB will be merged to become the final transformed analog voltage signal. For instance, if the digital-to-analog converters 40*r*, 40*b*, 40*g* directly transforms the "binary" digital data set into a "decimal" analog voltage signal, and the 6-bit digital data set are classified into two groups (the MSB and the LSB) with respectively assigned values (110,100), namely the MSB is (110) and the LSB is (100), the first determined voltage of the MSB is 48 Volts ($1*2^5+1*2^4=48$(V)), which will be first applied to and pre-charge the data lines 42*r*, 42*b*, 42*g*. Afterwards, the LSB is transmitted to the digital-to-analog converters 40*r*, 40*b*, 40*g* to determine the final transformed analog voltage signal, 52 Volts. Similarly, if the digital-to-nalog converters 40*r*, 40*b*, 40*g* directly transforms the "binary" digital data set into a "decimal" analog voltage signal, and the 6-bit digital data set are classified into two groups (the MSB and the LSB) with respectively assigned values (011,101), namely the MSB is (011) and the LSB is (101), the first determined voltage of the MSB is 24 Volts ($1*2^4+1*2^3=24$(V)), which will be first applied to and pre-charge the data lines 42*r*, 42*b*, 42*g*. Afterwards, the LSB is transmitted to the digital-to-analog converters 40*r*, 40*b*, 40*g* to determine the final transformed analog voltage signal, 29 Volts. Please notice that the sequence of transmission between the MSB and the LSB should not be constrained. Please refer to FIG. 4, which shows another embodiment of the data driver 30 according to the present invention. The embodiment as shown in FIG. 4 rearranges the sequence of transmission between the MSB and the LSB into the digital-to-analog converters 40*r*, 40*b*, 40*g*. As shown in FIG. 4, the first shift register 38 and the second shift register 39 still sequentially output the first switch signal SR1 and the second switch signal SR2. In addition, the first switch signal SR1 and the second switch signal SR2 are two adjacent pulse signals, and the first switch signal SR1 rises slightly earlier than the second switch signal SR2 does. The major difference between the embodiments in FIG. 2 and FIG. 4 is that after the first switch signal SR1 is operated, the LSB will first be transmitted to the digital-to-analog converters 40*r*, 40*b*, 40*g* combined with a previous MSB, which is previously transmitted to the digital-to-analog converters 40*r*, 40*b*, 40*g* in a previous frame time, to determine a temporary transformed voltage (cab be called a pseudo-transformed voltage) for pre-charging the data lines 42*r*, 42*b*, 42*g*. Afterwards, after the second switch signal SR2 is operated, the real MSB is transmitted to the digital-to-analog converters 40*r*, 40*b*, 40*g* to determine the final transformed analog voltage signal, which is also the real analog voltage signal to be applied to the data lines 42*r*, 42*b*, 42*g*. For instance, the digital-to-analog converters 40*r*, 40*b*, 40*g* directly transforms the "binary" digital data set into a "decimal" analog voltage signal, and the 6-bit digital data set are classified into two groups (the MSB and the LSB) with respectively assigned values (110,100), namely the MSB is (110) and the LSB is (100). In addition, a previous MSB transmitted in a previous frame time is assigned as (011). Therefore, the temporary determined voltage of the LSB and the previous MSB is 7 Volts ($1*2^2+1+2^1=7$(V)), which will be first applied to and pre-charge the data lines 42*r*, 42*b*, 42*g*. Afterwards, the real MSB is transmitted to the digital-to-analog converters 40*r*, 40*b*, 40*g* to determine the finally correct transformed analog voltage signal, 52 Volts.

The above-mentioned the data driver 30 of the present invention digital can be applied in various display devices, including an LCD, an LTPS LCD, an LED, an OLED, or a PLED.

In contrast to the prior art, the method of the present invention is executed by classifying an N-bit digital data set into m groups of digit data. Afterwards, m shift registers generate m adjacent pulse signals, and the m groups of digit data will be sequentially inputted into a set of latches for temporary storing according to the sequence of rising time of the m adjacent pulse signals. Therefore, each latch only requires including N/m latch circuits instead of including N latch circuits to deal with the N-bit digital data set. The space of the digital data driver according to the present invention can be reduced. Moreover, the group of digit data among the m groups of digit data first arriving to a corresponding digital-to-analog converter will pre-charge a corresponding data line to enhance the stability of the digital data driver.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A method for driving data in a data driver, the data driver driving at least a data line of a display device, the data driver comprising:

an input module comprising an N-bit circuit line for receiving an N-bit digital data set corresponding to color data of an individual pixel, the N-bit digital data set comprising m groups of digit data, wherein N and m are both integers greater than or equal to 2;

a plurality of latches electrically connected to the input module, each latch temporarily storing a group of digit data of the digital data set;

a plurality of shift registers for sequentially outputting a plurality of switch signals to determine a sequence by which the m groups of digit data are transmitted to the plurality of latches; and a digital-to-analog converter electrically connected to the plurality of latches for receiving the digital data set outputted from the plurality of latches to transform the digital data set into an analog voltage signal and to output the analog voltage signal to the data line;

the method comprising:

utilizing the N-bit circuit line of the input module to receive the digital data set;

utilizing the plurality of shift registers to sequentially output a plurality of switch signals to sequentially transmit the m groups of digit data to the plurality of latches for temporary storing;

sequentially transmitting the temporarily stored m groups of digit data to the digital-to-analog converter according to the sequence for the digital-to-analog converter to receive the digital data set; and utilizing the digital-to-analog converter to transform the digital data set into the analog voltage signal and to output the analog voltage signal to the data line;

wherein according to the sequence by which the shift register outputs the switch signals, a group of digit data among the m groups of digit data first arriving to the corresponding digital-to-analog converter will pre-charge the data line so as to display color data for the individual pixel.

2. The method of claim 1, wherein quantity of the shift registers is equal to the integer m, and the m shift registers generate the m switch signals.

3. The method of claim 1, wherein quantity of the shift registers is greater than the integer m.

4. The method of claim 2, wherein the m switch signals generated by the m shift registers are m adjacent pulse signals, and the m groups of digit data are sequentially transmitted to a grade of latches for temporary storing according to the sequence of rising time of the m adjacent pulse signals.

5. The method of claim 4, wherein the grade of latches at least comprises m latches.

6. The method of claim 4, wherein each latch of the grade of latches comprises N/m latch circuits, N/m being an integer.

7. The method of claim 4, wherein each latch of the grade of latches comprises a plurality of latch circuits whose quantity is slightly greater than the integer N/m.

8. The method of claim 4, wherein the temporarily stored m groups of digit data are sequentially transmitted from the grade of latches to the corresponding digital-to-analog converter according to the sequence of rising time of the m adjacent pulse signals.

9. The method of claim 1, wherein the display device is an LCD, an LTPS LCD, an LED, an OLED, or a PLED.

10. A data driver for driving at least a data line of a display device, the data driver comprising:

N bit-lines corresponding to an N-bit digital data set for receiving the digital data set and for classifying the N-bit digital data set into m groups of digit data, wherein N and m are both integers greater than or equal to 2, and the N-bit digital data set corresponds to color data of an individual pixel;

m shift registers for sequentially outputting m switch signals to determine a sequence by which the m groups of digit data are transmitted;

a plurality of latches electrically connected to the N bit-lines for temporarily storing the digital data set from the N bit-lines; and at least a digital-to-analog converter for receiving digital signals outputted from the plurality of latches to transform the digital signals into an analog voltage signal and to output the analog voltage signal to the data line;

wherein after the N bit-lines receive the N-bit digital data set and classify the N-bit digital data set into m groups of digit data, the m groups of digit data % ill be sequentially transmitted to the corresponding latch for temporary storing according to the sequence by which the m shift registers generate the switch signals, and the temporarily stored m groups of digit data will be sequentially transmitted to the corresponding digital-to-analog converter according to the sequence, and afterwards the digital-to-analog converter will transform the digital signal into the analog voltage signal and output the analog voltage signal to the data line so as to display color data for the individual pixel.

11. The data driver of claim 10, wherein the m switch signals generated by them shift registers are m adjacent pulse signals, and the m groups of digit data are sequentially transmitted to a grade of latches for temporary storing according to the sequence of rising time of the m adjacent pulse signals.

12. The data driver of claim 11, wherein the grade of latches comprise at least m latches.

13. The data driver of claim 11, wherein each latch of the grade of latches comprises N/m latch circuits, N/m being an integer.

14. The data driver of claim 11, wherein each latch of the grade of latches comprises a plurality of latch circuits whose quantity is slightly greater than the integer N/m.

15. The data driver of claim 11, wherein the temporarily stored m groups of digit data are sequentially transmitted from the grade of latches to the corresponding digital-to-analog converter according to the sequence of rising time of the m adjacent pulse signals.

16. The data driver of claim 10, wherein the display device is an LCD, an LTPS LCD, an LED, an OLED, or a PLED.

17. The method of claim 4, wherein each latch of the grade of latches comprises a plurality of latch circuits whose quantity is greater than the integer N/m.

18. The data driver of claim 11, wherein each latch of the grade of latches comprises a plurality of latch circuits whose quantity is greater than the integer N/m.

* * * * *

UNITED STATES PATENT AND TRADEMARK OFFICE

CERTIFICATE OF CORRECTION

PATENT NO. : 7,081,879 B2
APPLICATION NO. : 10/249751
DATED : July 25, 2006
INVENTOR(S) : Sun et al.

It is certified that error appears in the above-identified patent and that said Letters Patent is hereby corrected as shown below:

On the title page item (54) and col. 1, line 1, change "DATA DRIVER AND METHOD USED IN A DISPLAY DEVICE FOR SAVING SPACE" to --DATA DRIVER AND RELATED METHOD USED IN A DISPLAY DEVICE FOR SAVING SPACE--

Signed and Sealed this

Fifteenth Day of April, 2008

JON W. DUDAS
*Director of the United States Patent and Trademark Office*